US006355304B1

(12) United States Patent
Braun

(10) Patent No.: US 6,355,304 B1
(45) Date of Patent: Mar. 12, 2002

(54) ADHESION PROMOTION

(75) Inventor: Hillarion Braun, Phoenix, AZ (US)

(73) Assignee: Summit Coating Technologies, LLC., Elmhurst, IL (US)

( * ) Notice: Subject to any disclaimer, the term of this patent is extended or adjusted under 35 U.S.C. 154(b) by 0 days.

(21) Appl. No.: 09/089,154

(22) Filed: Jun. 2, 1998

(51) Int. Cl.[7] ..... B05D 1/36; B05D 7/00; B05D 7/26; B05D 1/02

(52) U.S. Cl. ..... 427/250; 427/404; 427/407.1; 427/407.2; 427/412.1; 427/412.4; 427/421

(58) Field of Search ..... 427/250, 404, 427/407.1, 407.2, 412.1, 412.4, 421; 428/416, 418, 901

(56) References Cited

U.S. PATENT DOCUMENTS

| | | | | |
|---|---|---|---|---|
| 2,993,806 A | | 7/1961 | Fisher et al. | 117/71 |
| 3,267,007 A | | 8/1966 | Sloan | 204/15 |
| 3,783,012 A | | 1/1974 | Morita et al. | 117/107 |
| 3,914,472 A | | 10/1975 | Nakanishi et al. | 427/250 |
| 3,955,024 A | * | 5/1976 | Goldman et al. | 428/209 |
| 4,101,698 A | | 7/1978 | Dunning et al. | 428/31 |
| 4,112,190 A | | 9/1978 | Sato et al. | 428/457 |
| 4,152,195 A | | 5/1979 | Bahrle et al. | 156/656 |
| 4,216,246 A | | 8/1980 | Iwasaki et al. | 427/43 |
| 4,232,086 A | | 11/1980 | Mori et al. | 428/341 |
| 4,402,998 A | | 9/1983 | Kumagai et al. | 427/97 |
| 4,407,685 A | | 10/1983 | Hankland | 156/212 |
| 4,444,848 A | | 4/1984 | Shanefield et al. | 428/624 |
| 4,650,723 A | | 3/1987 | Furuya | 428/622 |
| 4,720,401 A | | 1/1988 | Ho et al. | 427/250 |
| 4,869,930 A | | 9/1989 | Clarke et al. | 427/252 |
| 4,968,854 A | | 11/1990 | Benn, Sr. et al. | 174/35 GC |
| 5,068,493 A | | 11/1991 | Benn, Sr. et al. | 174/35 GC |
| 5,070,216 A | | 12/1991 | Thornton | 174/35 GC |
| 5,107,070 A | | 4/1992 | Benn, Sr. et al. | 174/35 GC |
| 5,132,172 A | | 7/1992 | Simpson et al. | 428/336 |
| 5,205,751 A | | 4/1993 | Schwartrz et al. | 439/86 |
| 5,273,816 A | | 12/1993 | Olson et al. | 428/272 |
| 5,317,195 A | | 5/1994 | Ishikawa et al. | 257/737 |
| 5,512,365 A | | 4/1996 | Miyazawa et al. | 428/332 |
| 5,928,767 A | * | 7/1999 | Gebhardt et al. | 428/209 |

OTHER PUBLICATIONS

Bruins, Paul F. Epoxy Resin Technology, pp. 229–232, 1968.*

U.S. Navy 3M 2216 B/A Gray, Sprayable Epoxy Coating, Preliminary Instructions For Use May 11, 1988.

6–page Technical Data sheet by 3M Scotch–Weld entitled 2290 Epoxy Adhesive/Coating, dated Apr. 1, 1993.

6–page Technical Data sheet by 3M Scotch–Weld entitled Epoxy/Adhesive, dated Mar., 1995.

* cited by examiner

*Primary Examiner*—Paul Thibodeau
*Assistant Examiner*—Holly C. Rickman
(74) *Attorney, Agent, or Firm*—Leydig, Voit & Mayer, LTD

(57) ABSTRACT

A product resulting from and a method of applying a metal or metallic plating including the steps of providing a substrate, including polymeric and elastomeric substrates, coating the substrate with a relatively thin layer of epoxy-solvent combination, the epoxy being a resin-rich two-part epoxy, metal plating the coated substrate, fully curing the epoxy.

18 Claims, 1 Drawing Sheet

ADHESION PROMOTION

FIELD OF THE INVENTION

Figure 1:
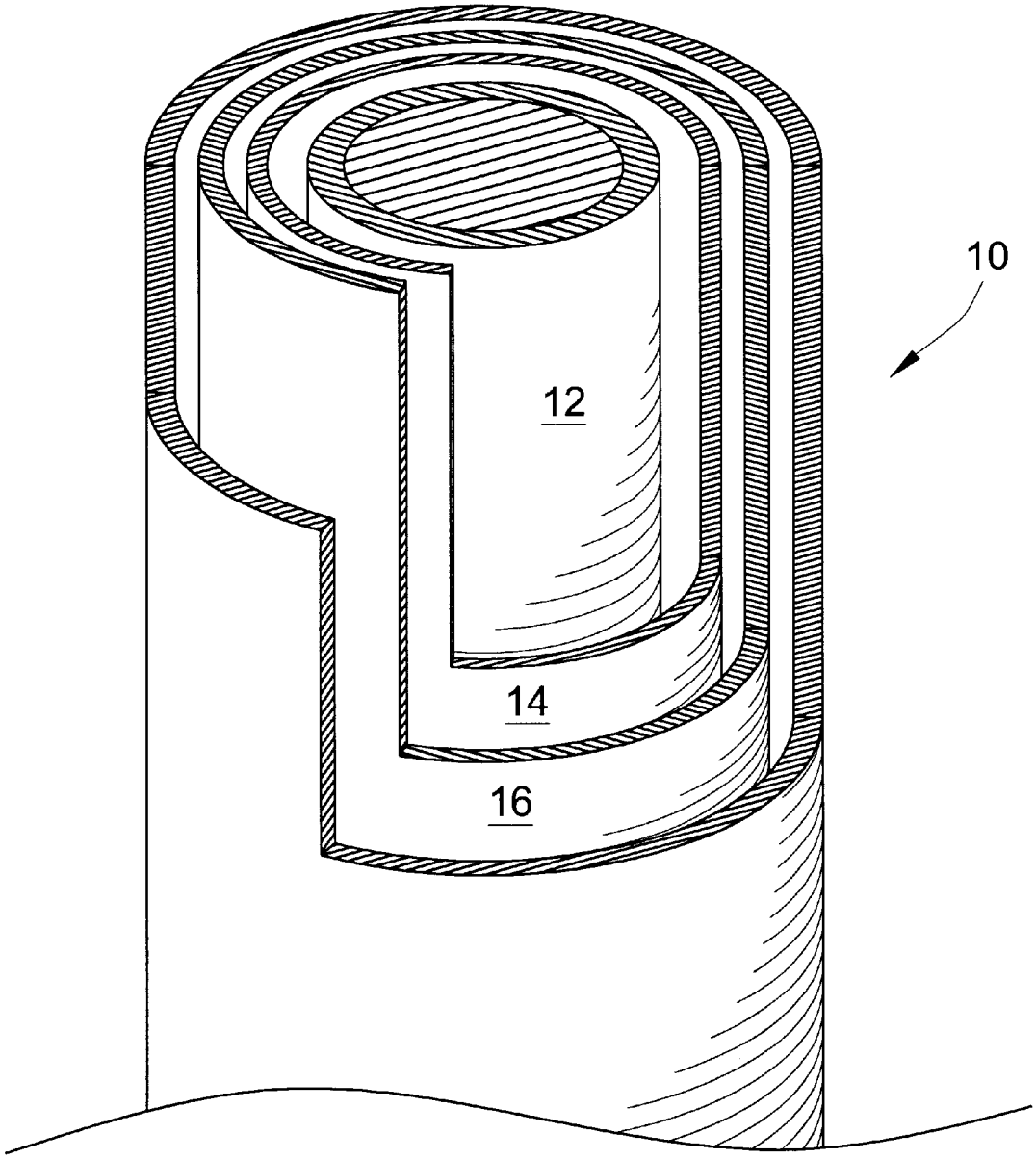

The present invention relates to metal plating and more particularly to substances used to increase adhesion during the metal plating process.

BACKGROUND OF THE INVENTION

Many products are coated or plated with metal. Chrome, gold, silver and many other metal or metallic substances are used as coatings. The products being coated or plated are quite varied, including mirrors, automobile parts, light bulbs, and toys as a few common examples. Such products are coated for aesthetics (e.g. jewelry), reflectivity (e.g. mirrors), rust-proofing (e.g. some automobile parts) and a wide variety of other reasons. A common feature with all products, types of coating and purposes of the coatings is a strong desire for the metal plating to remain in place. Chipping and flaking are highly undesirable occurrences. Chipping or flaking of the metal or metallic coating is often the basis for disposal of the entire product.

Metallic coatings are applied to a variety of materials, including polymers, elastomers and metals. Of particular difficulty is causing a metal coating to remain adhered to elastomers and polymers. Metal plating has been performed using extreme vacuums to increase adhesion to some materials. Base coats, usually a lacquer or varnish, are used to increase adhesion between the substrate and the aluminum (or other metal) condensate. These base coats often do not stick to plastics or elastomers. The base coat will often crack when the elastomer is bent or otherwise deformed. These difficulties with the base coat lead to chipping or flaking problems with the metal coating. What is needed is an improved base coat or method of metal plating polymers and elastomers.

SUMMARY OF THE INVENTION

The present invention includes an adhesion promoter that is flexible and adheres to many elastomers and/or plastics. The inventive adhesion promoter provides a strong bond between the metal coating and the substrate and flexibility that avoids or diminishes the cracking and flaking common with products and methods of the past. Elastomers are often porous, providing poor surfaces for adhesion of the metal plate. The present invention creates a relatively non-porous skin at the surface of the elastomer, increasing the ability of the metal to adhere thereto.

The adhesion promoter is flexible and adheres to many elastomers and/or plastics. The promoter is preferably a resin-rich two-part epoxy such as "3M Scotchweld 2216 Translucent Epoxy Adhesive", made by 3M Industrial Specialty Division, St. Paul, Minn. 55144, which can be dissolved in several solvents. The promoter, in its pre-cured state, is sprayed onto a substrate surface to form a thin relatively uniform film, which is then partially cured. A metal, such as Al, can then be vapor deposited after which the promoter, epoxy film, is allowed to fully cure, forming a bond not only with the substrate, but also with the metal coating.

IN THE FIGURES

FIG. 1 is a prospective view showing the present invention in a partial cut-away with phantom lining.

DETAILED DESCRIPTION OF THE INVENTION

The present invention 10, as shown in FIG. 1, is a metal plated product, including a plastic, elastomeric, combination or other such substrate 12, a resin-rich two-part epoxy 14 and a metal plating 16. The epoxy 14 acts as an adhesion promoter between the metal plating 16 and the substrate 12. Various tests using a variety of substrates 12, epoxies (with varying solvents) 14, and metals 16 have been conducted, such tests being reported further below. The material forming the substrate 12 is understood to be non-critical with the main feature being a material that would be desirably metal plated.

The present invention 10 is designed to improve depositing metal plating 16 on any substrate 12 and particularly on substrates 12 formed of elastomers and polymers. The invention 10 is understood to function with all or nearly all polymers and elastomers. This product 10 and process is particularly well suited to applying coatings 16 to the following polymers: Acrylonitrile Butadiene Styrene ("ABS"), polycarbonate, Polyetherimide ("ULTEM"), acrylics and macroblends and the following elastomers: Ethylene Propylene ("EPDM"), santoprene and nitrile.

The epoxy 14 should be a two-part epoxy, preferably resin-rich, i.e. unfilled epoxies. The epoxy 14 should be thin or dissolvable in any of a variety of solvents to thin out the epoxy while in its pre-cured state. The most preferred two-part epoxy 14 is sold by Minnesota Mining and Manufacturing Corporation under the trade name "3M Scotchweld 2216 Translucent Epoxy Adhesive". Other suitable two-part epoxies 14 include, but are not limited to EPO-TEK 301-2 and EPO-TEK 353ND sold by Epoxy Technology, Inc. 14 Fortune Drive, Billerica, Mass. 01821; United Resin Corp E Cast F-28 Clear sold by United Resin Corp., 4359 Normandy Conn., Royal Oak, Minn. 48073; and Norbond 816T sold by Norlabs, Inc. 565 Eagle Rock Avenue, Roseland, N.J. 07068. These epoxy films 14 atop various substrates 12 can easily be formed by dilution or otherwise very viscous epoxy 14 and then spraying this dilution to film thickness of a fraction of 0.001 inch. Dilution of a normally viscous epoxy 14 makes possible the dipping or spraying which would otherwise not be possible. Use of a two part epoxy 14 allows for a large selection of epoxies and application techniques. Whenever viscosity of an epoxy can be decreased by dilution with appropriate solvents, the application method of spraying is assured and is for most cases the preferred method.

The epoxy 14 preferably remains flexible after being cured, avoiding the cracking and chipping problems that are so common with varnishes and lacquers. For instance, the 3M Scotchweld 2216 Translucent Epoxy Adhesive remains in an amorphous configuration at or above 38 degrees Celsius and forms a crystalline structure below that temperature. An even more preferred epoxy 14 would perhaps not form a crystalline structure absent considerably cooler temperatures. The crystalline structure may provide the environment that allows for cracking and chipping.

The epoxy layer 14 may be between 5 $\mu$m and 100 $\mu$m thick and preferably is approximately 15 $\mu$m thick, although such thicknesses depend upon the epoxy used and the substrate 12. Very thin films of such epoxies 14 yield good adhesion of vacuum metalization on a wide variety of substrates 12. Epoxy film thicknesses of 5 micrometers have yielded good adhesion promoters. This may be due to the fact that at thicknesses of 5 micrometers or less, a plastic/epoxy surface modification takes place that represents adhesion sites different from those on a pure epoxy interface. Here, the small fraction of epoxy and large fraction of solvent may interact with the plastic substrate in such a way that the interface for the vacuum metalization is a blend of plastic and epoxy rather than pure epoxy. These thin films of epoxy 14 fully cure even though the full cure is generally reached more slowly than in massive layers where the exotherm aids in cure rate. Thus, such films 14 can also be used as top coats 18 where the issue of a full cure is of utmost importance.

Generally, when a thin layer is required for adhesion promotion, the weight ratio of epoxy to solvent can be as small as 5%. When the epoxy is used for a top coat or is being applied to a porous substrate the ratio can be as high as 30% or higher. For an optically transparent top coat 18, EPO-TEC 301-2, for example, can be applied by spraying a 10%–20% epoxy solvent ratio, forming a good clear top coat 18 that can be applied by spraying. Without such dilution, EPO-TEC 301-2 is far to viscous for spray or dip application.

Curing of two part epoxies 14 can be accelerated by heating. Each 10° C. increment in curing temperature may reduce the cure time by ½. For example, an epoxy 14 that reaches full cure in one hour at 80° C. will cure in ½ hour at 90° C. For many plastic substrates 12 elevated temperatures cause warping or other undesirable deformation. Reasonable cure rates can be achieved at room temperature (25° C.) and can be reduced dramatically at, for example, 60° C. to which most plastics can be exposed. In contrast, B stage epoxies generally need temperatures above 100° C. to which many plastics can not be exposed. The choice of solvents may depend in part on the particular substrate 12. Some two part epoxies 14 cannot fully be cured at temperatures compatible with the thermal stability requirements of some substrates 12. Thus, the appropriate epoxy 14 should be chosen in view of the family of substrates 12.

Many resin rich epoxies 14 can be diluted and reconstituted with a solvent made up of Methyl Ethyl Ketone ("MEK") and isopropyl alcohol. The MEK required is often a small fraction of the solvent and can be adjusted to act as a substrate 12 etch to assure a good bond between the epoxy 14 and substrate 12. The solvent should quickly and easily thin the epoxy 14 without destroying the chemistry of the epoxy 14, so that the epoxy 14 may be sprayed in a thin layer onto the substrate 12. The solvent (and epoxy 14) should not be of a variety that substantially destroys the substrate 12. While MEK is suitable, Ethyl, Methyl or Isopropyl alcohols as well as tetrahydrofuron or a mixture of any of these may partially etch the substrate 12 to augment adhesion of the epoxy film 14. Other suitable substrates 12 include but are not limited to composites, casting epoxy resins, painted surfaces, glass, ceramics polyvinyl chloride, chlorinated polyvinyl chloride and Ryton. The most preferred solvents are alcohol and MEK. Variations in dilution make possible very thin layers of epoxy 14 which are found to give excellent adhesion on polycarbonate, Acrylonitrile Butadiene Styrene ("ABS"), and Polycarbonate/ABS blends.

The metal plating 16 can be any of the metals or metallic substances commonly used for metal plating. The metal 16 should bond well with the particular epoxy 14 being used. Suitable metals 16 include but are not limited to aluminum, gold, silver, zinc, nickel, stainless steel and copper. Perhaps the most commonly used metal 16 is aluminum.

In operation, the epoxy 14, mixed per manufacturer's instructions, in its uncured state is thinned with a solvent such as alcohol and some MEK or tetrahydrofuron. The amount of the aggressive solvent is chosen to meet the requirements of the surface etch need and the solubility of a given epoxy in alcohol. The thinning may be done to reach a desired viscosity, perhaps allowing for a spray or dip application. The thinned epoxy may then be cooled to extend its pot life as required by the job.

The epoxy 14 is then sprayed or otherwise applied to the substrate 12, which may be formed of any material, including polymers and elastomers. Desirably the film 14 is thin and relatively uniform. The film 14 is partially cured perhaps at an elevated temperature compatible with the thermal stability of the substrate 12. The partial cure may be between 75% and 90% cure. The partial curing occurs prior to depositing the metal or metallic coating 16 in any known method such as vapor deposit. The epoxy 14 is then fully cured forming a bond between the substrate 12 and coating 16.

Although the present invention has been described with reference to preferred embodiments, workers skilled in the art will recognize changes may be made in form and detail without departing from the spirit and scope of the invention.

I claim:

1. A method of metal plating a product comprising:

mixing the epoxy and curing agent of a two-part epoxy to begin curing;

applying the two-part epoxy to a substrate;

vacuum metal plating the epoxy coated substrate prior to the end of curing and finishing curing the two-part epoxy.

2. The method of claim 1 wherein the two-part epoxy is thinned with a solvent after the mixing step to form a thinned epoxy.

3. The method of claim 2 wherein the thinned epoxy is applied to the substrate by spraying.

4. The method of claim 2 wherein the thinned epoxy is applied to form a thin layer on the substrate having a thickness less than or equal to 0.001 inch.

5. The method of claim 2 further comprising the step of curing the thinned epoxy prior to metal plating to an extent of between approximately 75% and 90% fully cured.

6. The method of claim 2 further comprising the step of etching the substrate using the thinned epoxy.

7. The method of claim 1 wherein the step of vacuum metal plating comprises the step of vapor depositing a metal plating on the substrate.

8. The method of claim 1 wherein the step of vacuum metal plating comprises the step of sputtering metal on the substrate.

9. The method of claim 2 where in the weight ratio of two-part epoxy to solvent is approximately 5% to 30%.

10. The method of claim 2 wherein the thinned epoxy is sprayed to form a layer having a thickness in the range of approximately 5 $\mu$m to 100 $\mu$m.

11. The method of claim 1 wherein the substrate is selected from the group consisting of plastics, elastomers and combinations thereof.

12. The method of claim 1 wherein the two-part epoxy is a resin-rich epoxy.

13. A method of metal plating a substrate comprising:

mixing a two-part epoxy;

thinning the epoxy with a solvent to form a thinned epoxy;

applying the thinned epoxy to the substrate;

partially curing the thinned epoxy;

metal plating the epoxy coated substrate; and finish curing the thinned epoxy.

14. The method of claim 13 wherein:

a weight ratio of two-part epoxy to solvent of approximately 2% to 10%.

15. The method of claim 13 wherein the thinned epoxy is applied to form a layer having a thickness in the range of approximately 1 $\mu$m to 10 $\mu$m.

16. The method of claim 13 wherein the thinned epoxy is partially cured prior to metal plating to an extent of between approximately 75% and 90% fully cured.

17. The method of claim 13 wherein the substrate is selected from the group consisting of plastics, elastomers and combinations thereof.

18. The method of claim 13 wherein the solvent is selected from the group consisting of: Methyl Ethyl Ketone, Ethyl alcohol, Methyl alcohol, Isopropyl alcohol, tetrahydrofuron and any mixtures thereof.

* * * * *